United States Patent [19]

Pfeil, Jr. et al.

[11] Patent Number: 5,024,061

[45] Date of Patent: Jun. 18, 1991

[54] RECOVERY PROCESSING AND STORAGE UNIT

[75] Inventors: Richard A. Pfeil, Jr., Arlington, Va.; Charles M. Pirrera, Perry Hall, Md.

[73] Assignee: Terrestrial Engineering Corporation, Arlington, Va.

[21] Appl. No.: 448,812

[22] Filed: Dec. 12, 1989

[51] Int. Cl.[5] ..... F25B 45/00

[52] U.S. Cl. ..... 62/77; 62/292; 62/475

[58] Field of Search ..... 62/85, 292, 299, 475, 62/474, 149, 77, 195, 468, 470, 472

[56] References Cited

U.S. PATENT DOCUMENTS 3,232,070 2/1966 Sparano .
4,261,178 4/1981 Cain .
4,285,206 8/1981 Koser .
4,441,330 4/1984 Lower et al. .
4,476,688 10/1984 Goddard .
4,539,817 9/1985 Staggs et al. .
4,646,527 3/1987 Taylor .
4,766,733 8/1988 Scuderi .
4,768,347 9/1988 Manz et al. .
4,809,515 3/1989 Hauwink .
4,887,435 12/1989 Anderson ..... 62/292

*Primary Examiner*—Henry A. Bennet
*Attorney, Agent, or Firm*—Banner, Birch, McKie & Beckett

[57] ABSTRACT

A refrigerant recovery processing and storage unit (RPSU) for removing and storing refrigerant from an air conditioning and refrigeration system (AC&R) is disclosed. The unit creates a pressure difference between the inlet and outlet side of the AC&R, and a pressurized motivating gas is delivered to the inlet and flows therethrough to the outlet. The pressurized gas flow drives the refrigerant fluid from the AC&R. The RPSU separates the mixed refrigerant from the pressurized gas, and delivers the separated refrigerant to a detachable storage unit. After the AC&R is repaired, the refrigerant is returned from the storage tank to the AC&R.

110 Claims, 5 Drawing Sheets

RECOVERY PROCESSING AND STORAGE UNIT

BACKGROUND OF THE INVENTION

1. Technical Field

The present invention relates to a refrigerant recovery processing and storage unit, and more particularly to a recovery processing and storage unit and method wherein pressurized gas is utilized to remove any type of halogenated (HFC) or chlorinated (CFC) fluorocarbon refrigerant from small, medium or large sized air conditioning and refrigerating units.

2. Description of the Prior Art

Air conditioning and refrigeration systems (AC&R) make use of many types of HFC's or CFC's as the working refrigerant fluid. When the systems need to be repaired, the refrigerant fluid is generally released to the atmosphere, causing the breakdown of the ozone layer, which allows harmful radiation to reach the earth. Since such releases of refrigerant fluids are now or soon will be illegal, a way to remove refrigerant from the AC&R's without releasing them to the atmosphere is desired.

Refrigerant recovery processes and systems are known in the prior art, for example, as described in U.S. Pat. No. 4,476,688 to Goddard, refrigerant is pumped directly from a non-functional refrigeration unit by a compressor. In particular, the refrigerant drawn from the refrigeration unit is directed through an oil trap and an acid purification filter dryer to remove lubricating oil and other impurities before the refrigerant gas enters the compressor. The refrigerant drawn from the unit is compressed and passed through a condenser coil where the hot compressed gas is converted to a liquid. The liquified refrigerant is directed to a receiving tank and is discharged therefrom directly back into the refrigeration unit when repaired. In addition, some of the liquified refrigerant is returned to the condensing coil to effect condensation of the heated gaseous refrigerant flowing therethrough.

In U.S. Pat. No. 4,766,733 to Scuderi, a system is shown in which a standard refrigerant receiver is disposed in a circuit between a refrigeration system to be evacuated, and a compressor of a reclamation unit. The receiver includes a first port linked to a tube extending generally down to the bottom of the receiver, a second port linked to a second tube which extends only partially into the receiver, and a third port linked to a tube also extending generally down to the bottom of the receiver. During evacuation of the refrigerant from the unit, the first port is linked to the outlet of the system to be evacuated, and the second port is linked to a port leading to the inlet of the compressor. The third port is closed. The interior of the receiver charges with a small amount of refrigerant gas until the pressure in the receiver is equal to the pressure in the system to be evacuated.

The compressor is turned on, and refrigerant gas from the top of the receiver is drawn through the second tube and into the inlet of the compressor and thereafter enters the condenser. Removal of the gaseous refrigerant from the receiver has the effect of lowering the pressure in the receiver, which boils off a small amount of the liquid refrigerant at the bottom of the receiver which tends to cool the refrigerant entering the receiver from the system to be evacuated. Since the refrigerant in the receiver is constantly cooled, the pressure in the receiver is always maintained below that of the system to be evacuated until all of the refrigerant is removed.

When the system has been completely evacuated and serviced, the outlet of the compressor is linked to the third port of the receiver, and the first port of the receiver is connected to the inlet of the system from which the refrigerant has been evacuated. The second port of the receiver, that is, the port connected to the short tube is linked to the inlet of the compressor. The compressor is turned on, and the refrigerant gas is drawn from the receiver, compressed in the compressor and thereafter returned to the receiver as a heated and compressed gas through the third port. The heated and compressed gas warms the liquid refrigerant at the bottom of the receiver, thereby increasing the pressure in the receiver and causing liquid and gaseous refrigerant to flow out of the first port and back into the system to be charged.

The known prior art systems are typically small portable units designed for automobile air conditioning and home appliance applications. During operation the compressor directly contacts the refrigerant which is being pumped from the refrigeration system. Since the known systems all use a compressor to remove the refrigerant from the system, and since compressors can generally only be designed to be used with one specific type of refrigerant, that is, compressors are unique for either low, medium or high pressure refrigerants, the overall recovery systems are limited to recovery of only a specific type of refrigerant.

For example, the above discussed prior art is limited to removal of CFC R12. Additionally, the above prior art systems are only useful for removing small quantities of refrigerant from small systems, typically less than four pounds. Furthermore, since compressors are designed to be used only with specific lengths of suction hose line, the applications of the above systems are limited to refrigeration systems from which refrigerant may be conveniently evacuated with certain hose lengths. The design of the systems is further complicated by the fact that only refrigerant in the gaseous state may enter the compressor. If liquid refrigerant enters the compressor, damage will occur. Finally, the known prior art systems cannot be constructed to ensure that no refrigerant escapes from the system and enters the atmosphere.

SUMMARY OF THE INVENTION

A refrigerant recovery processing and storage unit (RPSU) for recovering refrigerant fluid from refrigeration and air conditioning systems (AC&R) is disclosed. The unit includes a gas motivating and pressurizing section which supplies pressurized motivating gas to an inlet of the refrigeration system and which creates a lower pressure at an outlet of the refrigeration system than at the inlet. The motivating gas flows through the refrigeration system due to the pressure difference between the inlet and the outlet and forces refrigerant fluid to flow from the outlet. The unit also includes a storage section for storing the refrigerant fluid forced from the refrigeration system.

In a further embodiment, a separating section separates the motivating gas from the refrigerant after they are mixed in the motivating and pressurizing section.

In a further embodiment, the gas motivating and pressurizing section includes a compressor for pressurizing the motivating gas. The pressurized gas flows both to the refrigeration system inlet and to an ejector linked to the outlet. The ejector ejects the motivating gas to create a lower pressure at the outlet than at the inlet.

In a further embodiment, a capacity control system is disposed between a conduit linking the compressor outlet to the ejector, and a conduit linked to the compressor inlet. The capacity control system ensures that the pressure at the compressor outlet does not exceed a predetermined level, and that the volume of gas flowing to the compressor inlet does not fall below a minimum level.

In a still further embodiment, the separating section includes a tank which is maintained at a temperature and pressure which causes refrigerant gas flowing therein to condense. The liquified refrigerant flows through a conduit to the storage section.

In a still further embodiment, a processing section is disposed between the ejector and the refrigeration system outlet to ensure that all of the refrigerant flowing to the ejector is in the gaseous state. The processing section also cleans and dries the refrigerant by removing oil and water.

In a still further embodiment, a liquid assurance circuit is disposed between the refrigerant outlet of the separating section and the storage section and prevents motivating gas from flowing to the storage section.

In a still further embodiment, the storage section includes a detachable storage tank.

Since in the present invention only motivating gas flows through the compressor one advantage of the invention is the elimination of the requirement of having the compressor directly contact the refrigerant gas and compressing it. Since the compressor does not directly contact the refrigerant gas, the limitations inherent in using a compressor to evacuate the refrigeration system are avoided. For example, since the compressor of the present invention does not directly contact the refrigerant gas, the system of the present invention can be used to remove and store a variety of different types of refrigerant gases having low, medium or high pressurization points. Furthermore, since the system utilizes the difference in pressure created by the gas motivating and pressurizing section, a large capacity of refrigerant may be recovered from the system, generally in the five ton plus capacity range with a compressor having a much smaller capacity. Of course, the system can be economically used with smaller refrigeration units as well, with the same compressor.

Additionally, the use of a detachable storage tank allows the unit to be used to evacuate refrigerant from other refrigeration systems while the storage tank remains behind. After the refrigeration system is repaired, the RPSU can be brought back to the first site to pump the stored refrigerant back into the refrigeration unit. Finally, the recovery processing and storage unit of the present invention allows for substantially complete removal and capture of the refrigerant from the AC&R with substantially zero release of refrigerants into the atmosphere.

The invention will be more clearly understood from the detailed description of the preferred embodiments with reference to the drawings.

DETAILED DESCRIPTION OF THE PREFERRED EMBODIMENT

Figure 1:
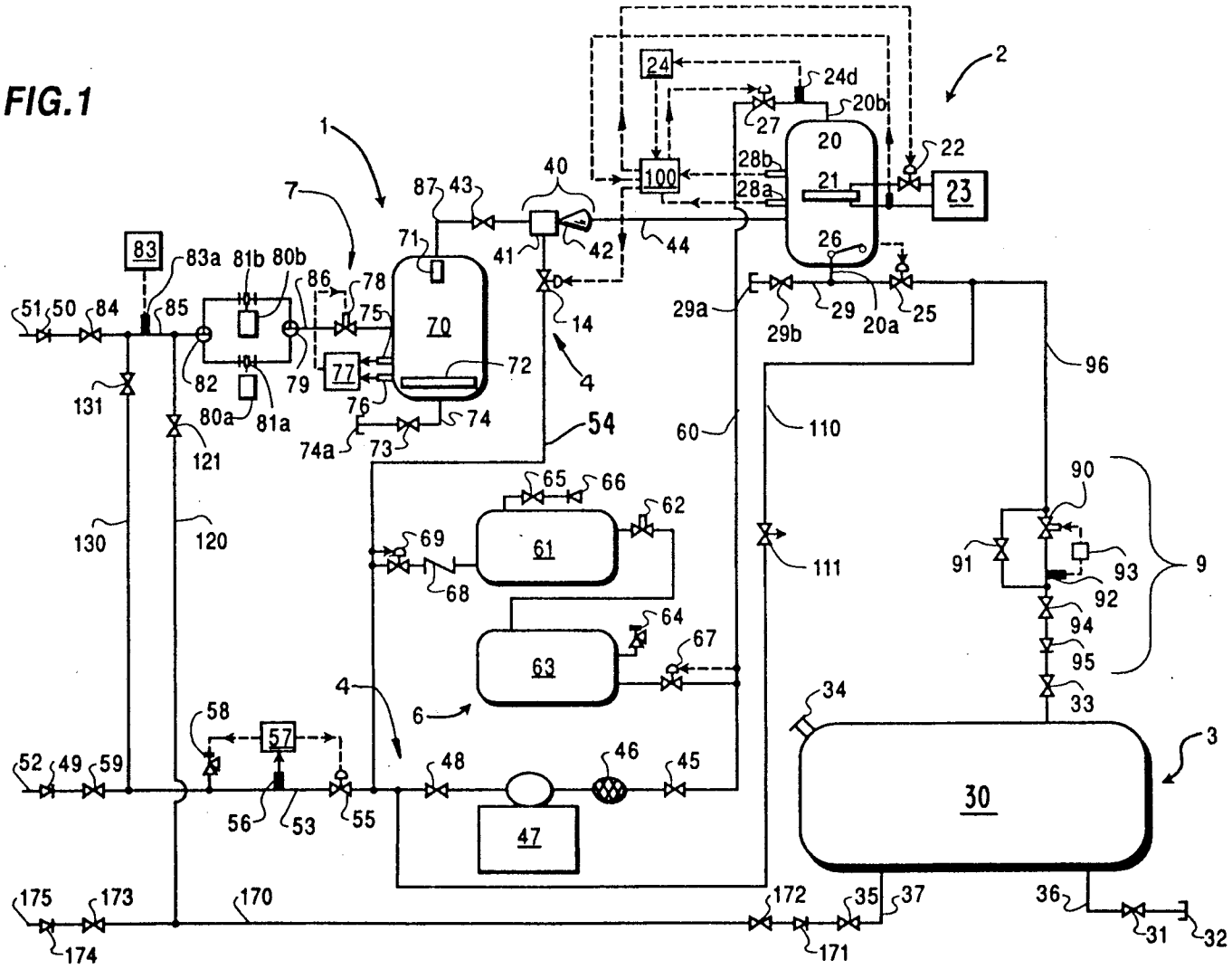
FIG. 1 is a schematic view of a refrigerant recovery and processing unit (RPSU) according to the present invention.

The refrigerant recovery, processing and storage unit (RPSU) is disclosed in FIG. 1. RPSU 1 is portable, and may be transported in a small truck or trailer. RPSU 1 includes drive gas pressurizing and motivating section 4 (motivating section), processing section 7, separating section 2, liquid assurance circuit 9, storage section 3, and capacity control system 6. Motivating section 4 pressurizes and circulates a refrigerant evacuating and purging gas through an air conditioning or refrigeration system (hereinafter, jointly denoted as AC&R or simply as a refrigeration system) which is to be pumped down, that is, from which refrigerant is to be removed. Motivating section 4 also creates a pressure differential across the pump down inlet and outlet of the AC&R. The pressurized motivating gas flows from the inlet to the outlet, in the form of a gas cap or bubble which effectively drives the refrigerant fluid from the AC&R.

Processing section 7 is linked to the outlet of the AC&R. Processing section 7 removes water and lubricating oil from the refrigerant fluid being recovered, as well as from the motivating gas flowing from the outlet of the AC&R. Separating section 2 receives the dry and oil free refrigerant and motivating gas which is mixed in the low pressure side of motivating section 4, and separates the motivating gas from the refrigerant by causing the refrigerant to condense. Liquid assurance circuit 9 is disposed at the outlet of separating section 2. Liquid assurance circuit 9 assures that only liquified refrigerant and not motivating gas flows therethrough to storage section 3. Storage section 3 stores the refrigerant until it is to be returned to the AC&R.

Finally, capacity control section 6 is disposed between discharge header or conduit 54 which links the outlet of compressor 47 with the inlet of ejector 40 of motivating section 4, and conduit 60 linking the inlet of compressor 47 of motivating section 4 to the motivating gas outlet of separating section 2. Capacity control system 6 ensures that a nearly constant volume of motivating gas enters and exits compressor 47 of motivating section 4 at all times during operation, and that the pressure in conduit 54 does not exceed a predetermined level, regardless of the operating state of other elements of RPSU 1. RPSU 1 may be used to pump down AC&R units utilizing any type of halogenated fluorocarbon (HFC) or chlorinated fluorocarbon (CFC).

With further reference to FIG. 1, each of the above sections will be further disclosed. For purposes of explanation only, in the following description, the motivating gas which is utilized in RPSU 1 is disclosed as molecular nitrogen $N_2$, and many of the elements of RPSU 1 will be described in terms of their effects on nitrogen. However, the invention is not limited to the use of nitrogen as the motivating gas and any suitable motivating gas may be used in RPSU 1. For example, any inert gas may be used as the motivating gas. Additionally, each of the described numbered elements of each section of RPSU 1 is of a known type and function and is either readily available to one skilled in the art or would be easily assembled from conventional components.

Motivating section 4 includes compressor 47 for pressurizing and circulating nitrogen through the system that is, for providing pressurized nitrogen for the gas cap drive. Compressor 47 is an oil-free, double acting piston compressor of the cross head type, and is known in the prior art. In this configuration, the compressing pistons are connected by a connecting rod to a moving cross-head member, and the cross head member is in turn connected to the crank shaft by a further connecting rod. The cylinder in which the pistons are disposed is isolated from the crank case, thereby preventing crank case lubricating oil from contacting the compressing elements. Conversely, the nitrogen is prevented from reaching the crank case. The use of this type of compressor ensures that only the nitrogen motivating gas will be circulated through RPSU 1. The power for operating the compressor may be supplied by an internal combustion engine or by an electric motor which is integrated to the crank shaft of the compressor.

Motivating section 4 further includes inlet isolation valve 45 and inlet particulate filter 46 which are sequentially disposed in low pressure nitrogen conduit 60 at the inlet of compressor 47. Nitrogen from separating section 2 flows through conduit 60 and is drawn into compressor 47 through valve 45 and filter 46 and is compressed therein, and is discharged at an elevated pressure through outlet isolation valve 48 at the outlet of compressor 47. The outlet of compressor 47 is linked via valve 48 to both discharge header 54 and to nitrogen outlet conduit 53 which are disposed in a parallel arrangement.

Conduit 53 includes purge control (PC) valve 55, pressure transducer 56 and relief valve 58 disposed in series therein. Control system 57 is linked to valves 55 and 58 and transducer 56, and may include a microprocessor. Control system 57 controls the degree of opening of PC valve 55, monitors the pressure in conduit 53 through pressure transducer 56, and automatically adjusts the setting of relief valve 58. Outlet isolation valve 59 and quick disconnect fitting 49 are disposed in outlet conduit 53, downstream of valves 55 and 58 and transducer 56. Quick disconnect fitting 49 links RPSU 1 to the inlet of the AC&R from which the refrigerant is to be recovered, by flexible transfer nitrogen line (TNL) 52 of any suitable length and type.

Figure 2:
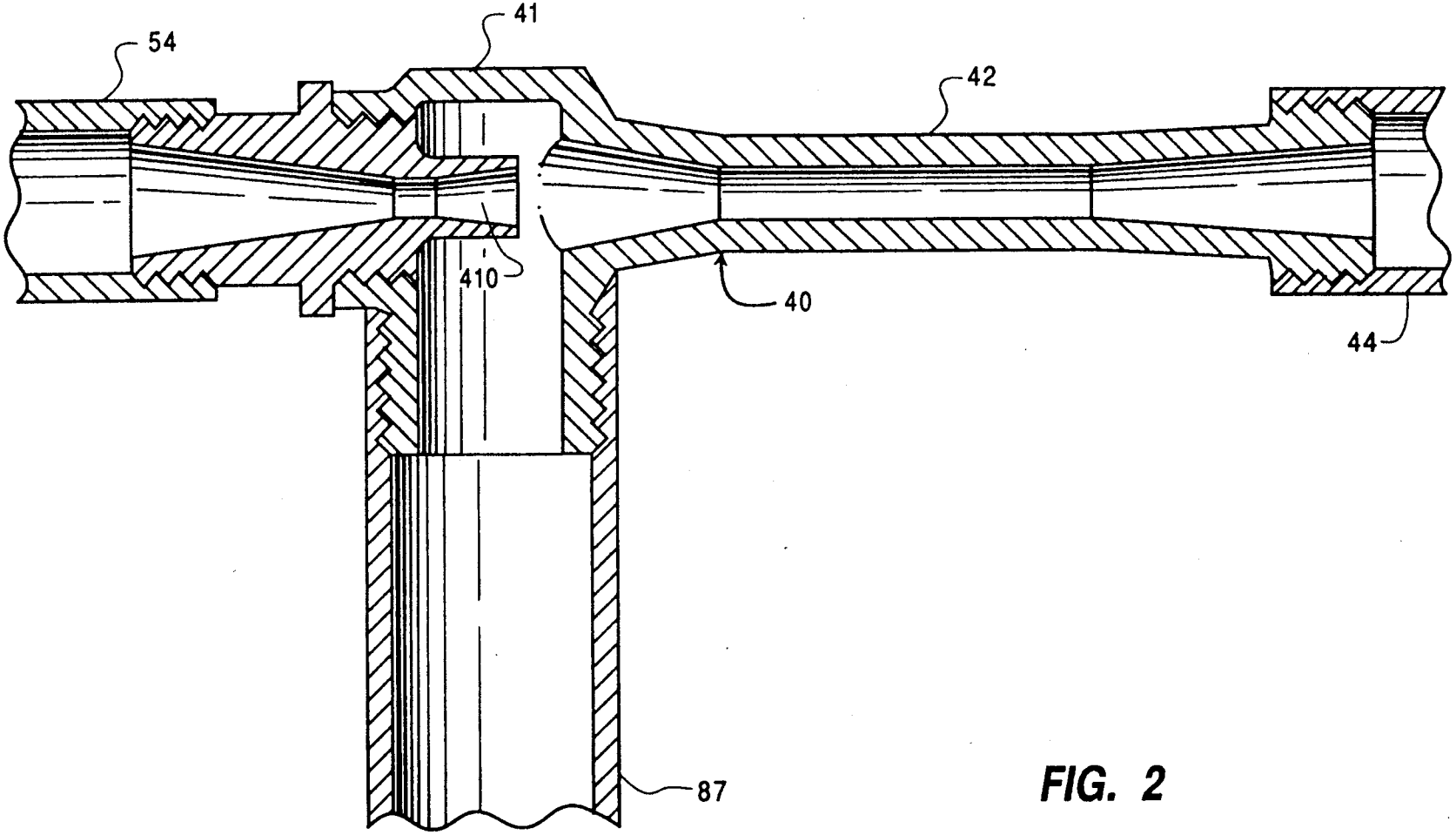
FIG. 2 shows an ejector forming part of the RPSU of FIG. 1.

Motivating section 4 further includes ejector 40 linked to the outlet of compressor 47 by discharge header 54, and throttle control valve 14 disposed in header 54. Ejector 40 is further shown in FIG. 2 and includes bowl 41 and diffuser 42. The lowest pressure point in RPSU 1 is in bowl 41. Nozzle 410 is linked to header 54 and is disposed in bowl 41 such that the outlet of nozzle 410 is substantially within the opening linking bowl 41 to diffuser 42. Nozzle 410 ejects high pressure motivating gas such that the pressure of the gas just after exiting the outlet of nozzle 410 is generally reduced, and the velocity is generally increased. That is, nozzle 410 coverts the high pressure motivating gas into a high velocity stream which passes from the outlet of nozzle 410. A low pressure is thereby created at the outlet of nozzle 410.

Bowl 41 includes an opening linked to conduit 87 from vacuum oil separator tank 70. Ejector inlet isolation valve 43 is disposed in conduit 87. The motivating gas ejected from nozzle 410 moves into the expanded region of diffuser 42, entraining gases found in bowl 41, thereby lowering the pressure in bowl 41, and causing the gas in bowl 41 to flow towards diffuser 42 and to be discharged therefrom. The entrained gas from bowl 41 mixes with the motivation gas and acquires part of its energy with the result that the velocity of the mixture is decreased and the pressure is diffuser 42. The overall effect is to create a vacuum in bowl 41 which is propagated through conduit 87 to create a low pressure in tank 70. Diffuser 42 is further linked to ejector outlet conduit 44 leading to separating section 2. Ejector 40 is of known type and is readily available to one skilled in the art.

Finally, motivating section 4 includes inlet isolation valve 84 and inlet quick disconnect fitting 50 which is linked to the pump down outlet of the AC&R via flexible transfer suction line (TSL) 51 of any suitable length and type. It should be noted that the terms inlet and outlet when used with respect to the AC&R may change in dependence on whether the system is being pumped down or is being refilled with stored refrigerant. Therefore, the AC&R outlet for the pump down procedure may serve as the inlet for refilling the AC&R with the cleaned, dried and stored refrigerant.

Processing section 7 is disposed between inlet isolation valve 84 and ejector inlet isolation valve 43 of motivating section 4, and receives the flow of refrigerant and nitrogen from the outlet of the AC&R. In fact, processing section 7 may be considered as a subsection of motivating section 4, and the motivating effect of ejector 40, that is, the vacuum created in bowl 41 of ejector 40, is transferred to the outlet of the AC&R via processing section 7, and works in conjunction with the gas cap drive to remove the refrigerant fluid from the AC&R as discussed more fully below.

Processing section 7 includes refrigerant and nitrogen gas inlet conduit 85 linked to quick disconnect fitting 50. Inlet isolation valve 84 is disposed in conduit 85. Halocarbon analyzer detector **83*a* and control monitor 83 are also disposed in conduit 85 and detect the presence of CFC or HFC in the outlet flow from the AC&R such that when the analyzer reads zero presence of CFC or HFC, pure nitrogen is flowing through conduit 85 indicating that the pump down and purge of the AC&R is complete and that all of the refrigerant has been removed. Processing section 7 further includes left dehydrator 80*a* and right dehydrator 80*b* disposed in parallel, and linked to the outlet side of conduit 85 via three way directional valve 82. Dehydrators 80*a* and 80*b* are known T-type low side cannister type dryers and serve to remove moisture from the refrigerant and nitrogen. Left and right moisture indicators 81*a* and 81*b*, respectively, are installed in the "T's" of each dryer 80*a* and 80*b*, and indicate when the desiccant in each dryer has been depleted and should be replaced. Three way valve 79 is disposed at the outlet of dehydrators 80*a* and 80*b***.

Dried refrigerant and nitrogen flowing from the dehydrators travels through intermediate conduit 86 and into vacuum oil separator tank 70. Solenoid level control valve 78 is disposed in conduit 86 and is controlled by level control box and monitor 77 which monitors the level of liquid refrigerant in tank 70 via high level ultrasonic detector 75 and low level ultrasonic detector 76 which are disposed at different levels in the sides of tank 70, and which detect the state of the refrigerant at each level. Detectors 75 and 76 are known and detect the state of the refrigerant and thus the level of liquid refrigerant in tank 70 by sensing the velocity change in sonic transmission due to the difference in density between liquid and gaseous refrigerant. If the refrigerant in tank 70 is detected by lower detector 76 to be in the gaseous state at that level, control box and monitor 77 causes valve 78 to be opened, allowing more liquid refrigerant to enter tank 70. Conversely, if upper detector 75 senses that the level of liquid refrigerant has risen to that level, control box and monitor 77 closes valve 78 to prevent flow of refrigerant into tank 70.

The vacuum created in bowl 41 of ejector 40 results in low pressure in tank 70, which is transferred to TSL 51 via the intermediate elements of processing section 7. Therefore, a large pressure difference is created between TNL 52 at the inlet of the AC&R, and TSL 51 at the outlet of the AC&R. Further, due to the low pressure in tank 70, any refrigerant in the liquid state therein will boil such that only gaseous refrigerant will flow out of tank 70. The boiling rate in tank 70 equals the pump down rate of the AC&R in Lbm/hr.

Finally, anti-oil foam plate 72 is disposed at the bottom of tank 70, and prevents oil trapped in the well of tank 70 from boiling off with the refrigerant. Demister screen 71 is disposed at the top of the outlet of tank 70, and removes fine oil mist particles from the refrigerant to further ensure that no lubricating oil flows from tank 70 with the refrigerant and nitrogen. Oil drain pipe 74 is disposed at the bottom of tank 70 and includes oil drain valve 73 therein and pipe cap 74*a* thereon. The oil collected in tank 70 may be drained via pipe 74 when RPSU 1 has completed pump down and purge of the AC&R.

Capacity control system 6 is disposed between low pressure nitrogen returning conduit 60 linking the outlet of separating section 2 to the inlet of compressor 47, and discharge header 54 linking the outlet of compressor 47 to ejector 40 as discussed above. Capacity control system 6 includes, disposed sequentially from header 54 to conduit 60, high side regulating valve 69, flow check valve 68, high pressure accumulator 61, spill valve 62, low pressure accumulator 63, and low side regulating valve 67. Capacity control system 6 further includes charging line isolation valve 65 linked to high pressure accumulator 61 and quick disconnect coupling 66. Relief valve 64 is linked to low pressure accumulator 63.

Capacity control system 6 automatically maintains a nearly constant volumetric flow rate through compressor 47 no matter what the state of the various other elements of RPSU 1. In fact, if necessary, capacity control system 6 may pass therethrough the entire volumetric flow rate of compressor 47 to prevent a malfunction of compressor 47 should the compressor outlet pressure be too large or should the inlet volume to the compressor be too small. Charging line isolation valve 65 of capacity control system 6 ensures that the necessary volume of motivating gas is provided to the AC&R at the initiating of the pump down procedures. That is, extra nitrogen from an external source may be supplied to compressor 47 via valve 65 and coupling 66 at the initiation of pump down.

RPSU 1 further includes separating section 2 including separator tank 20. Separating section 2 separates the nitrogen from the refrigerant by condensing the refrigerant to the liquid state in separator tank 20. Nitrogen outlet 20*b* of separator tank 20 is disposed at the top of separator tank 20 and is linked to the inlet of compressor 47 by low pressure conduit 60. Separator control valve 27 is disposed in conduit 60 between separator tank 20 and compressor 47 to adjust the pressure within separator tank 20 by controlling the nitrogen outlet flow rate.

Condensing coil 21 is disposed in separator tank 20, and is linked to R-22 package refrigeration unit 23 at its inlet and outlet sides. Units 23 are known and available to those skilled in the art. Thermo-expansion valve 22 is disposed between refrigeration unit 23 and condensing coil 21. The flow of coolant through coil 21 from unit 23 is controlled by valve 22 to adjust the temperature within separator tank 20 (this coolant is distinct from the refrigerant which is to be pumped out of the AC&R). Pressure transducer 28*a* and temperature sensor 28*b* are also mounted on separator tank 20 and detect the temperature and pressure therein. Thermo expansion valve 22, pressure transducer 28*a*, temperature sensor 28*b*, separator control valve 27 and throttle control valve 14 of motivating section 4 are all linked to control system 100 which monitors the temperature and pressure within separator tank 20, and controls the pressure and temperature to ensure that conditions inside of separator tank 20 are such that the refrigerant may exist only in the liquid state therein. Therefore, the refrigerant condenses and is collected in the bottom of separator tank 20, and the nitrogen flows out of separator tank 20 and back to compressor 47 via low pressure conduit 60.

Separator section 2 also includes separator well float 26 disposed at the bottom of separator tank 20, near liquid refrigerant outlet 20*a*. Refrigerant outlet conduit 96 is linked to outlet 20*a* of separator tank 20, and tank well level control valve 25 is disposed in conduit 96 and is linked to float 26. Float 26 and valve 25 interact to maintain a minimum liquid refrigerant level in the well to provide a liquid seal at outlet 20*a* of separator tank 20 to ensure that the necessary condensing pressure is maintained in separator tank 20, with an adequate liquid flow to conduit 96.

Finally, collecting line 29 is also linked to outlet 20*a* of separator tank 20, and includes valve 29*b* and line cap 29*a*. Line 29 may be used to collect small amounts of refrigerant settled in separator tank 20 during RPSU self-purges and nitrogen gas cleansing evolutions. Halocarbon monitor analyzer 24 is linked to halocarbon detector 24*d* and disposed in nitrogen returning conduit 60 to detect the presence of unwanted refrigerant in the nitrogen outlet flow. Halocarbon monitor analyzer 24 is linked to control system 100. If refrigerant is detected, system 100 closes separator control valve 27 in conduit 60 to prevent refrigerant from flowing back to the inlet of compressor 47 with the nitrogen. Control system 100 is also linked to throttle control valve 14 in discharge header 54 and will cause valve 14 to close, preventing the flow of nitrogen to ejector 14 until the failure in separator section 2 can be corrected. In case of a shut down, flow through compressor 43 would be maintained by capacity control system 6.

Liquid refrigerant assurance circuit 9 is disposed in refrigerant conduit 96 between outlet 20*a* of separator section 2 and the inlet of storage section 3. Liquid refrigerant assurance circuit 9 includes quick closing valve 90 and ultrasonic detector 92 disposed downstream of valve 90 in conduit 96. Quick closing control system 93 is linked to ultrasonic detector 92 and quick closing valve 90 and controls the opening and closing of valve 90 based on the signal from detector 92. Detector 92 operates by detecting the change in the velocity of sonic transmission due to the density difference between nitrogen gas and liquid refrigerant and transmits a signal to monitor 93 should any gas be detected. Outlet isolating valve 94 is disposed in conduit 96 downstream of detector 92.

Liquid assurance circuit 9 prevents nitrogen from flowing to storage section 3 by the action of quick closing valve 90 when actuated by control system 93. Control system 93 monitors the input from ultrasonic detector 92 and closes valve 90 should any nitrogen be detected. Therefore, only liquid refrigerant flows into storage section 3. Finally, bypass valve 91 is disposed in parallel to the series arrangement of valve 90 and detector 92, and allows liquid refrigerant to be back flushed around valve 90 in order to flood detector 92, so as to allow valve 90 to be opened during start up procedures when nitrogen may be present in conduit 96.

Storage section or receiver module 3 is disposed to receive liquid refrigerant from separating section 2 via liquid assurance circuit 9. Storage section 3 includes detachable receiver module 30 which may be easily removed and replaced via quick disconnect fittings 95 and 171. Inlet isolation valve 33 and burst disc 34 are disposed on receiver module 30. Sampling outlet pipe 36 is linked to a sampling outlet of receiver module 30, and sampling valve 31 is disposed in pipe 36. Pipe cap 32 is disposed at the end of pipe 36. Refrigerant restoring conduit 37 is linked to the main refrigerant outlet of receiver module 30, and outlet isolation valve 35 and quick disconnect fitting 171 are disposed therein.

RPSU 1 includes recovery pressure conduit 110 linked between the outlet of compressor 47 at a location in refrigerant conduit 96 after well level control valve 25 and before liquid assurance circuit 9. Pressure recovery valve 111 is disposed in conduit 110 and may be opened along with valve 91 when it is desired to use pressurized nitrogen during refrigerant refilling of the AC&R.

Refrigerant recovery conduit 170 is linked to restoring conduit 37 via quick disconnect 171. Outlet isolation valve 172 is disposed in conduit 170. The other side of conduit 170 includes outlet valve 173 and quick disconnect 174. When it is desired to refill the AC&R with the stored refrigerant, conduit 170 is linked to the refrigerant refill inlet of the AC&R via quick disconnect fitting 174 and transfer return line (TRL) 175 of suitable type and length.

Finally, purge and vacuum drag conduit 120 is linked between refrigerant and nitrogen gas inlet conduit 85 and refrigerant recovery conduit 170. Valve 121 is disposed in conduit 120. Nitrogen purge cross connect conduit 130 is linked between conduit 85 and nitrogen outlet conduit 53, at a position between relief valve 58 and outlet isolation valve 59. Valve 131 is disposed in conduit 130.

Figure 3:
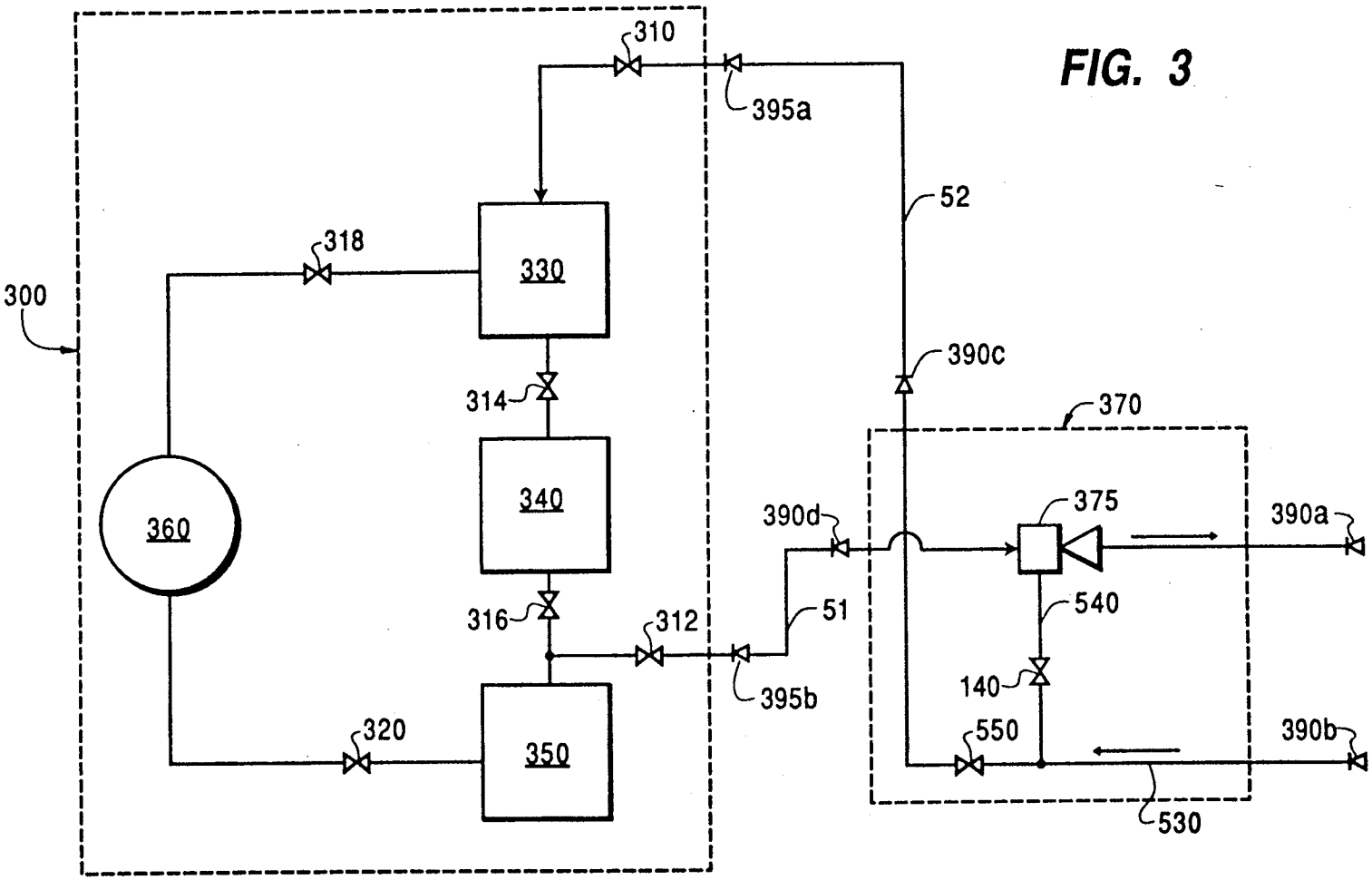
FIG. 3 shows a schematic view of a typical air conditioning and refrigeration system (AC&R), and the line-up for connecting the AC&R to the RPSU of the present invention for removing refrigerant from the AC&R, and also shows a portable booster ejector manifold for use with longer hose lines.
Figure 4:
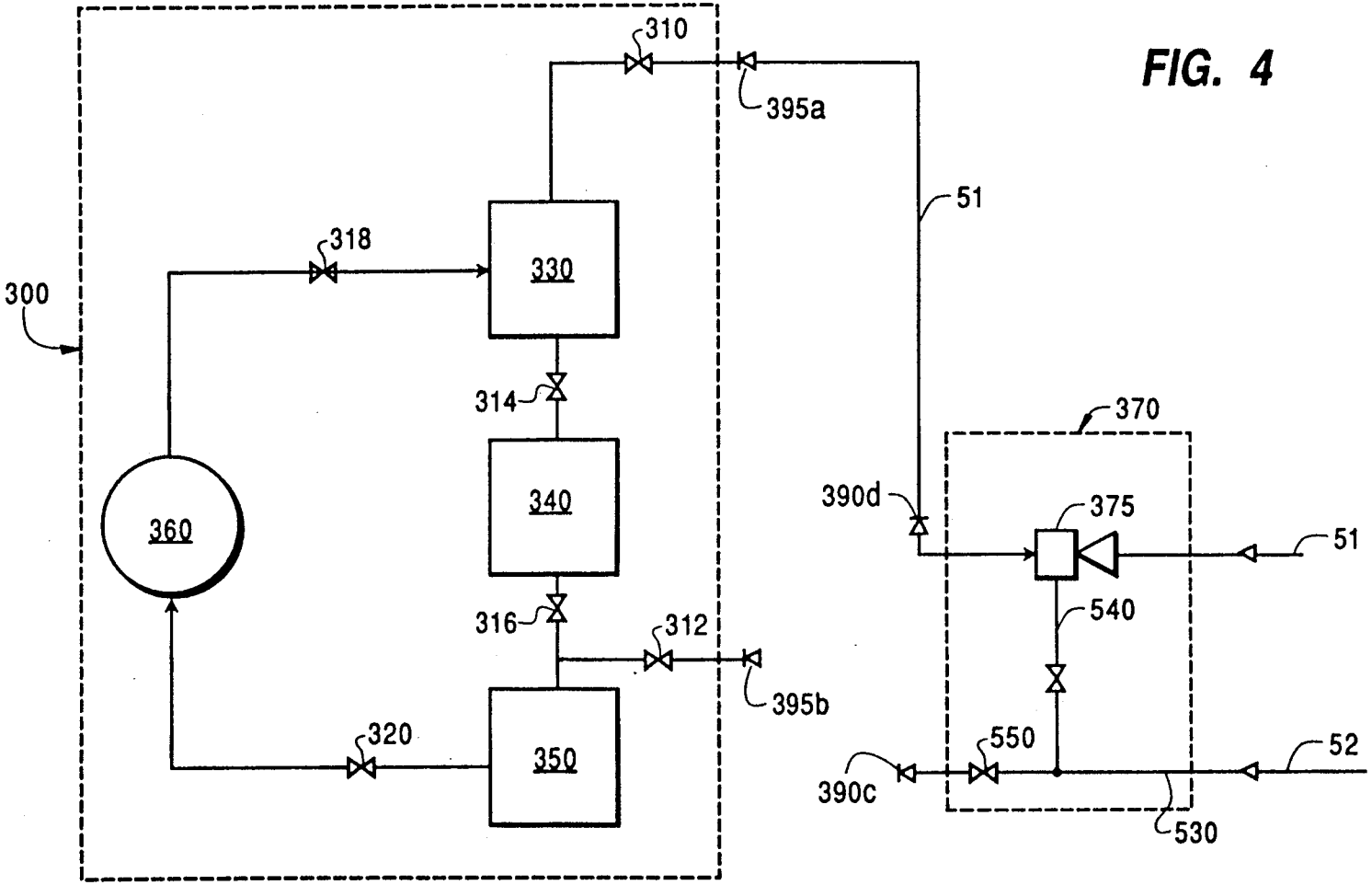
FIG. 4 shows a schematic view for removing the motivating gas blanket from the AC&R.
Figure 5:
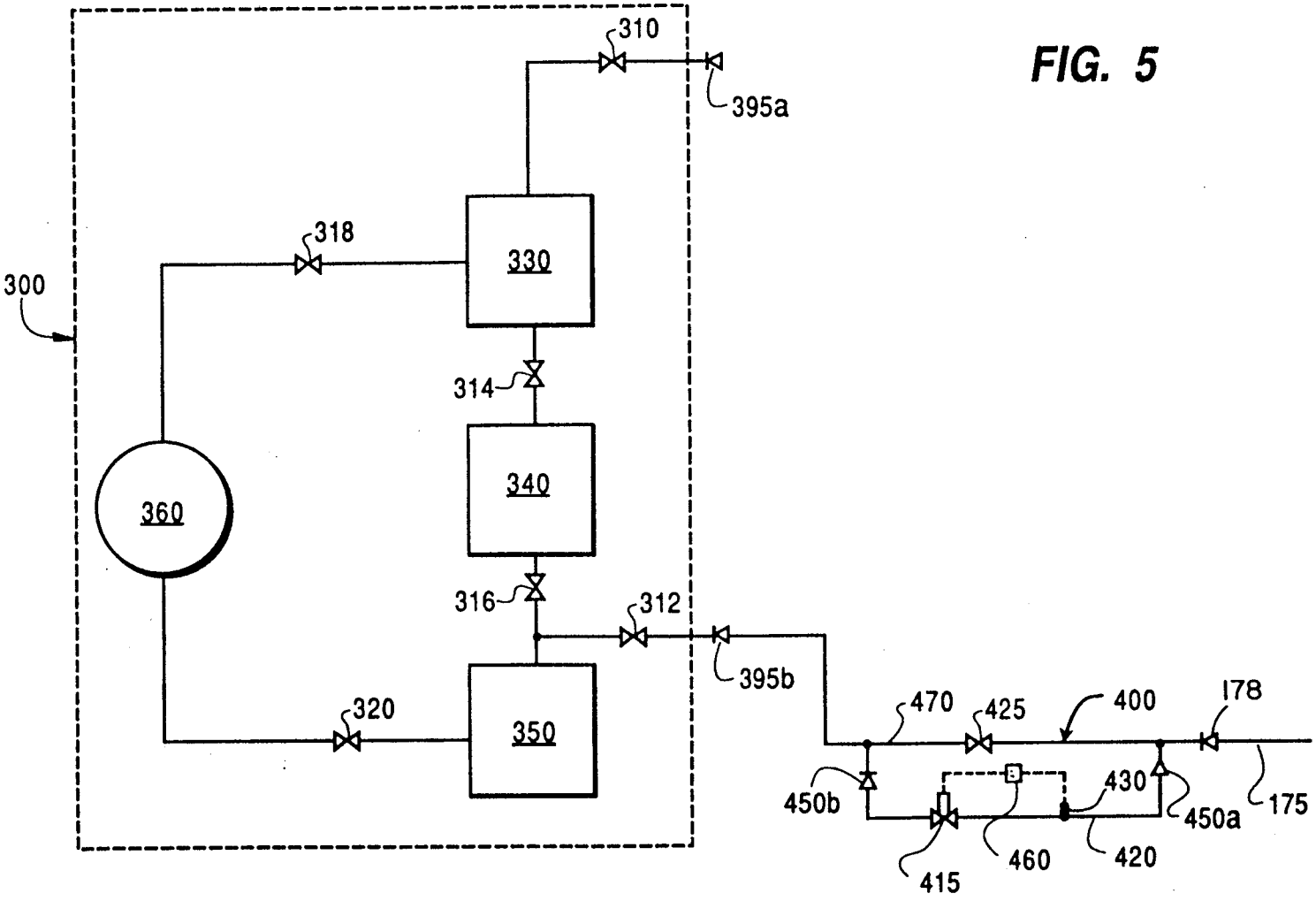
FIG. 5 shows a schematic view for restoring the refrigerant to the AC&R.

With further reference to FIGS. 3–5, a typical air conditioning and refrigerant system which may be pumped down by RPSU 1 of the present invention is shown. RPSU 1 may be utilized for both air conditioning and refrigeration systems of many types which for the sake of convenience of description are shown simply as AC&R 300. For example, refrigerant may be evacuated from an air conditioning or a refrigerating system used in a large building, or on a ship by RPSU 1 of the present invention. It is to be understood that the following description of AC&R 300 is provided only as a representative example of systems with which RPSU 1 could be utilized to remove, store and replace refrigerant. Additionally, the procedure discussed below to be followed in utilizing RPSU 1 with AC&R 300 is provided merely for the sake of convenience of description. RPSU 1 of the present invention is not limited to use with AC&R 300, and may be utilized with any air conditioning or refrigeration system. Furthermore, the exact procedure for removal, storage and restoration of refrigerant with any particular AC&R would vary according to the structure of the unit. However, it would be within the skill of one skilled in the art to utilize RPSU 1 with any AC&R unit so as to remove, store and replace substantially 100% of the refrigerant.

AC&R 300 includes compressor 360, condenser 330, receiver 340, and evaporator 350 connected in a series arrangement. A plurality of isolation valves 314, 316, 318, and 320 are disposed between the elements of AC&R 300. Purge valve 310 is linked to a filling inlet of condenser 330. Charging connection 312 is linked between valve 316 and evaporator 350. In general, any AC&R 300 will have some means for isolating the various elements of the system, which for the sake of simplicity are shown as valves 310, 312, 314, 316, 318 and 320, as well as a filling inlet, although, the system may utilize other isolating mechanisms.

In operation, AC&R 300 would circulate refrigerant in a known manner, such that compressed refrigerant exits compressor 360 and flows through condenser 330. The refrigerant condenses in condenser 360 and liberates heat. Condensed refrigerant flows to receiver 340 which serves as a temporary storage location. Condensed refrigerant controllably flows from receiver 340 to evaporator 350 where the condensed refrigerant absorbs heat and evaporates. The gaseous refrigerant flows from evaporator 350 back to the inlet of compressor 360.

With further reference to FIGS. 1 and 3, a procedure for removing refrigerant from AC&R 300 will be described. TNL 52 linked to outlet conduit 53 of RPSU 1 is connected to AC&R 300 at purge valve 310. The connections are made at quick disconnect fittings 49 and **395*a*. Transfer suction line 51 of RPSU 1 is connected to AC&R 300 at charging connection 312 through quick disconnect fittings 50 and 395*b*. If necessary, portable ejector manifold 370 may be linked between RPSU 1 and AC&R 300. Portable ejector manifold 370 is only necessary when there is a significant pressure loss in the transfer hose lines, for example, when the hoses linking RPSU 1 to the AC&R 300 are longer than 300 feet. Manifold 370 includes booster ejector 375 which would be connected between transfer suction line 51 of RPSU 1 and charging connection 312 of AC&R 300. Suitable quick disconnect fittings 390*a* and 390*d* are disposed in the Suitable quick disconnect fittings 390*a* and 390*d* are disposed in the lines leading from booster ejector 375 and would be linked with quick disconnect fittings 50 and 395*b* respectively. Nitrogen from compressor 47 is supplied to booster TNL line 530 which is disposed in series with TNL 52 by suitable quick disconnect fittings 390*b* and 390*c*. Valve 550 is disposed in booster TNL 530, and booster throttle control valve 140 is disposed in booster header 540, which is disposed between booster TNL 530 and booster ejector 375. Valve 140 performs a similar function to valve 14 in header 54. Booster ejector 375 functions similarly to ejector 40. The effect of booster ejector 375 is to offset large head loss in TSL 51**.

Before RPSU 1 operation is initiated, isolation valve 316, purge valve 310 and charging connection 312 would be closed. Compressor 360 would operate to compress as much of the refrigerant in AC&R 300 as possible, and the regrigerant would be condensed in condenser 330 and stored in receiver 340. After compressor 360 is operated for a suitable length of time, isolation valves 318 and 320 would be closed, and compressor 360 would be shut off. Purge valve 310 and charging connection 312, as well as isolation valve 316 would be opened, such that condenser 330 and receiver 340 would be part of a circuit which includes ejector 40 and compressor 47, as well as the other elements of RPSU 1, and booster ejector 375 if needed.

Pump down operation of RPSU 1 would be initiated. Valves 35, 111, 121, 131, would be closed. Compressor 47 receives nitrogen from low pressure conduit 60. The low pressure nitrogen flows through inlet isolation valve 45, inlet particulate filter 46 and into the inlet of compressor 47. The nitrogen is compressed in compressor 47 and flows out thereof through outlet isolation valve 48. The high pressure nitrogen from valve 48 flows both into discharge header 54 and into nitrogen outlet conduit 53. The high pressure nitrogen flowing into discharge header 54 flows through throttle control valve 14 and into nozzle 410. The nitrogen is ejected from nozzle 410 creating a vacuum in bowl 41 as discussed above. The pressure in tank 70 is greatly reduced and extremely low pressure is established at TSL 51 and charging connection 312.

The strength of the vacuum in ejector 40 is determined by the nitrogen flow rate into nozzle 410, which is determined by the position of throttle valve 14. The position of throttle valve 14 is controlled by control system 100. Therefore, the low pressure seen at the outlet of receiver 340 is ultimately determined by control system 100. Simultaneously, the high pressure nitrogen flowing into conduit 53 further flows through TNL 52 and into condenser 330 via purge valve 310. Therefore, a large pressure difference is created between the fill inlet of condenser 330 and the outlet of receiver 340 due to the actions of ejector 40 in creating low pressure in TSL 51, and the high pressure nitrogen flowing into TNL 52. The emittance of high pressure nitrogen creates a nitrogen gas cap or bubble which moves through condenser 330 and receiver 340, and in conjunction with the low pressure in TSL 51, drives the refrigerant therefrom and into TSL 51 and processing section 7. Initially, the gas cap drive will force about 95% or more of the refrigerant from condenser 330 and receiver 340 into TSL 51. Thereafter, circulation of nitrogen through condenser 330 and receiver 340 continues as a "nitrogen purge" to remove substantially 100% of the refrigerant, at which point halocarbon detector **83*a* will detect zero presence of refrigerant in conduit 85. As further described below, processing section 7 removes water and lubricating oil from the refrigerant, and also ensures that the refrigerant leaving processing section 7 and entering bowl 41 of ejector 40** is in the gaseous state.

The completely gaseous refrigerant is sucked into bowl 41 due to the vacuum created at nozzle 410. Refrigerant gas is drawn to nozzle 410 where it is entrained by the nitrogen stream. The nitrogen and refrigerant is mixed at nozzle 410, and flows to separating section 2 where the nitrogen and refrigerant are separated as described below. The flow of refrigerant into and out of bowl 41 and in diffuser 42 in sequence is self-perpetuating due to the action of ejecting nozzle 410. Furthermore, it is important that the refrigerant entering bowl 41 be in the gaseous state to prevent liquid refrigerant slugging of ejector 40. Gaseous refrigerant is ensured by the action of processing section 7.

The volume of nitrogen admitted into TNL 52, and thus the extent of the nitrogen gas cap drive is directly controlled by the position of PC valve 55. The degree of opening of PC valve 55 is itself controlled by PC valve control system 57 which receives output signals from pressure transducer 56 indicating the pressure in conduit 53. The pressure in conduit 53 is compared by control system 57 against a predetermined control point entered into system 57. The control point is unique for each AC&R 300 being pumped down, and is in general equal to the normal operating pressure of the high side of AC&R 300. Control system 57 opens or closes PC valve 55 as required to admit nitrogen gas into conduit 53 in order to maintain the pressure in TNL 52 at generally the prescribed pressure point, in order to ensure that the gas cap drive pressure on AC&R 300 is constant as the refrigerant is removed therefrom. In addition, control system 57 automatically adjusts the setting on relief valve 58 at 10% above the predetermined pressure point. Should PC valve 55 fail, relief valve 58 will release the excess nitrogen from conduit 50 to prevent over pressurization of AC&R 300. Since only pure nitrogen enters conduit 55, that is, no refrigerant can be mixed into the nitrogen entering compressor 47, the operation of relief valve 58 will not cause refrigerant to leak into the atmosphere.

As discussed above, the vacuum created in ejector 40 (as well as ejector 375 if it is used) creates a low pressure in vacuum oil separator tank 70 via refrigerant and nitrogen outlet 87, to maintain a low pressure in tank 70. The low pressure in tank 70 causes the refrigerant to flow therein via TSL 51, inlet isolation valve 84, inlet conduit 85 and intermediate conduit 86. Halocarbon analyzer detector **83*a* is disposed in conduit 85 and the refrigerant passes over it. During the initial pump down, only refrigerant will be flowing into conduit 85. However, during the purge stage, a mixture of nitrogen and refrigerant will flow into conduit 85, such that the percentage of nitrogen gradually increases. When halocarbon analyzer detector 83 detects a zero presence of carbon, pure nitrogen is flowing through conduit 85, indicating that the pump down and purge of refrigerant from AC&R 300** is completed.

Refrigerant in conduit 85 flows through three-way directional valve 82, and then into either left or right dehydrators **80*a* 80*b* where moisture is removed. The use of redundant dryer loops allows for switching to an idle loop should desiccant in one canister become depleted. The dried refrigerant passes through three-way valve 79, and intermediate conduit 86 including solenoid level control valve 78 and into tank 70. Since the interior of tank 70 is maintained at an extremely low pressure due to the vacuum effect of ejector 40, any liquid refrigerant present boils. Therefore, only gaseous refrigerant exits from the top of tank 70 and flows, along with the nitrogen during the purge stage of operation into conduit 87 and ejector 40. Furthermore, any oil carried by the refrigerant settles on the bottom of tank 70** due to the boiling of the refrigerant.

As a further provision against oil flowing out of tank 70 and into ejector 40, oil demister screen 71 is disposed at the refrigerant and nitrogen outlet of tank 70 and removes any fine oil mist particles from the refrigerant prior to leaving tank 70. Anti-oil forming plate 72 is disposed near the bottom of tank 70, and prevents oil trapped in the well of tank 70 from boiling off with the refrigerant. Oil drain pipe 74 is disposed at the bottom of tank 70 and pipe cap 74*a* is disposed at the end thereof. Oil drain valve 73 is disposed in pipe 74. After completion of the pump down and purge of AC&R 300, valve 73 is opened, and oil trapped in tank 70 may be forced out through valve 73 and cap 74*a* and into a waste oil collection tank due to remnant nitrogen pressure in the tank. Additionally, valves 59 and 84 may be closed and valve 131 in conduit 130 may be opened, causing pressurized nitrogen to flow directly from compressor 47 to separator tank 70, increasing the nitrogen pressure therein and forcing the oil out of tank 70 and into pipe 74.

During the pump down operation, the liquid refrigerant level in tank 70 may fluctuate. A level control system is utilized to prevent oil foaming, and carry-over of oil with liquid refrigerant out of tank 70, a as well as refrigerant slugging of ejector 40. That is, the level control system prevents liquid refrigerant, possibly mixed with oil, from leaving tank 70 and flowing into ejector 40. Should the level of the liquid refrigerant rise above the position of high level ultrasonic detector 75, detector 75 would detect the liquid refrigerant due to the density difference between the refrigerant gas and the refrigerant liquid. Detector 75 would transmit a signal to level control box and monitor 77, which would generate a further signal causing solenoid level control valve 78 to close. Therefore, further flow of refrigerant into tank 70 would be prevented and the liquid refrigerant level would boil down to prevent slugging of ejector 40. When the level of liquid refrigerant boils down to below the level of low level detector 76, detector 76 would sense the presence of gaseous refrigerant at that level and would transmit a signal to control box 77 which would open valve 78 to permit refrigerant to flow into tank 70.

Separating section 2 receives the gaseous refrigerant and nitrogen via ejector outlet conduit 44. The refrigerant and nitrogen are mixed in ejector 40. (Initially, the nitrogen present in ejector 40 comes only from compressor 47 via header 54, but as explained further below, eventually the refrigerant driven by the nitrogen gas cap will become increasingly mixed with the nitrogen.) The mixture flows into separator tank 20. The temperature and pressure within separator tank 20 are maintained at a point at which the refrigerant may exist therein in only the liquid state. Therefore, the refrigerant condenses and separates from the nitrogen. The temperature and pressure are detected by pressure transducer 28*a*, and temperature sensor 28*b* which transmit signals to separator control system 100, which utilizes a microprocessor to monitor conditions in separator tank 20. A program card such as a floppy disk which is unique to the refrigerant being separated in separator tank 20 provides the necessary program and data to the microprocessor.

Control system 100 adjusts thermo-expansion valve 22 to control the volume flow of coolant between coil 21 and refrigerating unit 23 to maintain the proper temperature in separator tank 20, and controls separator control valve 27 to maintain the proper pressure in separator tank 20. Of course, this control is based on the sensed temperature and pressure within separator tank 20. Control system 100 also adjusts throttle valve 14 in header 54 leading to ejector 40 to control the volume of nitrogen entering ejector 40 and thus controls the degree of vacuum created therein. Valves 22, 27 and 14 are controlled to ensure that the separator environment is at or above the saturation curve for the refrigerant, that is, the point where the refrigerant condenses within separator tank 20.

Nitrogen separated from refrigerant within separator tank 20 flows out of the top thereof to low pressure nitrogen conduit 60, which leads back to the inlet of compressor 47 where the nitrogen is compressed for further circulation through the system. Separator tank 20 utilizes cycloning and tortuous path regions to the outlet thereof to ensure the complete separation of the nitrogen from the liquid refrigerant, and that only dry nitrogen leaves the top of separator tank 20. Additionally, halocarbon monitor analyzer 24 is linked to detector 24*d* in conduit 60, an serves to detect the presence of any refrigerant. If refrigerant is detected, analyzer 24 sends an appropriate signal to control system 100 which will shut valves 14 and 27, ending the flow of refrigerant and nitrogen into and out of separator tank 20, until the failure can be corrected.

Liquid refrigerant collects in the bottom of separator tank 20, and flows therefrom into refrigerant conduit 96 due to the nitrogen pressure. Separator well float 26, and well level control valve 25 disposed in conduit 96 control the level of refrigerant in separator tank 20 to ensure that a liquid seal of refrigerant is maintained at the bottom of separator tank 20, so that the necessary pressure may be maintained in separator tank 20. When float 26 rises to its maximum level, indicating a high level of liquid refrigerant in separator tank 20, valve 25 is opened to allow maximum flow into conduit 96. When float 26 falls to a minimum level, indicating a minimally acceptable level of liquid refrigerant in separator tank 20, valve 25 is closed to prevent refrigerant flow into conduit 96 until the liquid level increases. After the pump down and purge of AC&R 300 is completed, float 26 can be manually overridden, and the nitrogen pressure will force the remnant refrigerant into conduit 96. Additionally, with valve 25 closed, valve 29*b* may be opened to allow collection of minute amounts of refrigerant which may collect in separator tank 20.

Liquid refrigerant flows into receiver module 30 through conduit 96. Liquid assurance circuit 9 is disposed in conduit 96 and assures that only liquid refrigerant flows into storage section 3 by blocking the flow of nitrogen therethrough. Quick closing valve 90 is disposed in conduit 96, and is activated by control system 93 which monitors the input from ultrasonic detector 92. Ultrasonic detector 92 continuously monitors the fluid in conduit 96, and will detect the presence of any gas which passes thereby due to the large density difference between gaseous nitrogen and the liquid refrigerant which will cause a large change in transmission speed between the transmitter and the receiver of detector 92. If a large change in speed is detected, a signal is relayed to control system 93, which transmits a signal causing quick closing valve 90 to close, thereby preventing nitrogen gas from entering storage section 300.

Bypass valve 91 allows liquid refrigerant to be back flushed, that is, to be pumped from a location in conduit 96 downstream of ultrasonic detector 92 in order to flood detector 92 so as to allow valve 90 to be opened during pump down start up procedures. Bypass valve 91 may also be used if necessary in conjunction with recovery pressure conduit 110, linked to the outlet of compressor 47, such that when valves 111 and 91 are opened, nitrogen may flow from compressor 47 through conduit 110 and into conduit 96 when it is desired to transfer the stored refrigerant from storage section 3 back to AC&R 300. The output of liquid assurance circuit 9 is linked to storage section 3 by outlet isolation valve 94, and quick disconnect fitting 95 which is linked to receiver module inlet isolation valve 33 on receiver module 30.

The refrigerant fluid flow from liquid assurance circuit 9 flows into receiver module 30 of storage section 3. Due to quick disconnects 95 and 171, receiver module 30 may be easily detached from RPSU 1 and left at the location of AC&R 300 while RPSU 1 is moved to a different location to pump down a different AC&R unit. The RPSU will be returned to the first site at a later time to retransfer the refrigerant from receiver module 30 back to AC&R 300. Also, variously sized receivers may be used for collecting refrigerant from various sized AC&R units. Furthermore, if different types of refrigerants are used at one site, the storage tank used with RPSU 1 can be changed so as to ensure that different refrigerants are not mixed while being recovered. Each refrigerant charge collected will be stored in its own receiver module and can be returned to the AC&R as required. In the case of extreme over-pressurization of module 30, burst valve 34 is provided and will release the refrigerant to prevent an explosion. In all other respects, module 30 securely stores the refrigerant.

Finally, capacity control system 6 is disposed between discharge header 54 and low pressure conduit 60 and serves to maintain a nearly constant volumetric flow of nitrogen into compressor 47, and a constant pressure in discharge header 54, independently of the actions of throttle valve 14, separator control valve 27 of separating section 7, and PC valve 55 so that compressor 47 may operate at a nearly constant volumeric flow rate without having to be adjusted in dependence on the state of the various other components of RPSU 1. The use of the high and low pressure accumulators in capacity control system 6 takes advantage of the cascading pressure potential between high pressure header 54 and low pressure conduit 60 in order to maintain the proper pressures in both the high and low pressure accumulators 61 and 63.

Spill valve 62 is located in the conduit between high pressure accumulator 61 and low pressure accumulator 63. Spill valve 62 monitors the pressure within accumulators 61 and 63. Should the pressure within low pressure accumulator 63 fall below the required value needed to replenish conduit 60 if necessary, spill valve 63 admits high pressure nitrogen from high pressure accumulator 61 to low pressure accumulator 63 to maintain the required level of pressure within low pressure accumulator 63. Alternatively, should the pressure within high pressure accumulator 61 become excessive, spill valve 62 will relieve high pressure gas from the high pressure accumulator 61 to low pressure accumulator 63 to maintain the pressure in high pressure accumulator 61 at a predetermined level, such that excess nitrogen from header 54 may flow into accumulator 61 if necessary.

Thus, spill valve 62 functions to ensure that the pressure within high pressure accumulator 61 does not exceed a predetermined maximum safe level and that pressure within accumulator 63 does not fall below a predetermined level. Therefore, by the use of high and low pressure accumulators, and spill valve 62, the capacity control system is always ready to take in excess nitrogen from header 54, or to supply needed nitrogen to conduit 60. Should excess pressure occur in both the high pressure and low pressure accumulators simultaneously with no demand for nitrogen in low pressure conduit 60, relief valve 64 releases low pressure nitrogen from low pressure accumulator 63 to the atmosphere until pressure in both accumulators is normalized. Additionally, charging valve 65 and quick disconnect 66 are located on high pressure accumulator 61 to replenish lost nitrogen, for example, such as may be encountered during RPSU startup. The replenishment nitrogen may be acquired from a nitrogen storage cylinder tank via a regulator (not shown in FIG. 1). Flow check valve 68 prevents return of nitrogen from accumulator 61 to header 54.

During operation of RPSU 1, if due to a closing of throttle control valve 14 in conduit 54 or of PC valve 55 in conduit 53, compressor 43 is forced to pump against a shut-off head, over pressurization of the nitrogen in header 54 could occur. However, high side regulating valve 69 prevents over-pressurization by relieving the excess pressure in header 54. The excess nitrogen flows through check valve 68 and into high pressure accumulator 61 where it is stored. Check valve 68 prevent back flow of nitrogen from high pressure accumulator 61 into header 54 should throttle valve 14 or purge valve 55 open at any time when high side regulating valve 69 is within its operating envelope. Conversely, lower side regulating valve 67 acts to prevent compressor 47 from being starved for input nitrogen should separator control valve 27 be closed to completely block flow of nitrogen from separator tank 20. Low side regulating valve 67 senses the pressure in compressor conduit 60 which links separator tank 20 with compressor 47. Should the pressure fall to below a predetermined level, valve 67 opens to allow replenishment nitrogen to flow from low pressure accumulator 63 into conduit 60 to maintain the suction line pressure and volumetric flow rate of nitrogen to compressor 47. Therefore, the volumetric flow rate both into and out of compressor 47 is maintained at a generally constant level.

After pump down and purge of AC&R 300 is complete, substantially 100% of the refrigerant in AC&R 300 between condenser 330 and receiver 340 will have been removed. Thus, nearly 100% of the refrigerant will have been removed overall. In order to remove any remaining refrigerant from AC&R 300 between evaporator 350 and compressor 360 inclusive, isolation valves 314 and 316 of AC&R 300 are closed, and purge valve 310 and charging connection 312 are closed. Compressor 47 of RPSU 1 continues to operate during this time due to the functioning of capacity control system 6 which passes all of the nitrogen therethrough. Isolation valves 318 and 320 are opened. Purge valve 310 and charging connection 312 are reopened. Therefore, condenser 330, compressor 360, and evaporator 350 are all in a circuit with ejector 40 and compressor 47, and receiver 340 is isolated. Nitrogen flows through condenser 330, compressor 360 and evaporator 350, removing any remaining refrigerant from AC&R 300 which is stored in storage section 3. The pump down and purge process continues as discussed above until halocarbon analyzer 83 indicates that no refrigerant is present in conduit 85, thereby indicating that all of the refrigerant has been removed. Valves 314 and 316 are then open for a short while to allow nitrogen to circulate in receiver 340. Purge valve 310 and changing connection 312 are closed, and RPSU 1 may be shut off. By using a nitrogen purge to remove the refrigerant remaining after pump down, a nitrogen blanket remains in AC&R 300 to prevent atmospheric air and contaminants from seeping into AC&R 300.

When it is desired to restore the refrigerant from storage section 3 to AC&R 300, the nitrogen blanket must first be removed. As shown in FIG. 4, outlet isolation valve 59 is closed and TNL 52 is disconnected from purge valve 310. Inlet isolation valve 84 is also closed, and TSL 51 is connected to purge valve 310. Booster ejector 375 may be interposed if necessary. Isolation valve 316 of AC&R 300 is closed as well, and isolation valves 314, 318 and 320 are left open. RPSU 1 is turned on such that compressor 47 and ejector 40 operate, as well as booster ejector 375, if necessary. The desired output of compressor 47 flows to ejector 40 (and ejector 375 if it is used), which creates a low pressure region at purge valve 310 through the intermediate elements as during pump down. The nitrogen flows through AC&R 300 in the direction of the arrows, and back to RPSU 1 where it is taken into capacity control system 6, and released to the atmosphere if necessary.

Thereafter purge valve 310 is closed, and RPSU 1 is shut off. As shown in FIG. 5, TSL 51 is disconnected from purge valve 310. Refrigerant return conduit 170 is connected to charging connection 312 via TRL 175. TRL 175 may be linked to portable $N_2$ sensing manifold 400 including quick disconnect fitting 178 and valve 425 which are disposed in conduit 470 linking TRL 175 and quick disconnect fitting **395*b*. Parallel conduit 420 is linked to conduit 470 on either side of valve 425 by suitable quick disconnect fittings 450*a* and 450*b*. Quick closing valve 415 and halocarbon sensor 430 are disposed in parallel conduit 420 and are linked to control 460. Manifold 400 is linked as close as possible to AC&R 300**, that is, the length of hose therebetween should be as small as possible.

In order to restore the refrigerant to AC&R 300, it may only be necessary to open outlet isolation valve 172 in conduit 170, and outlet isolation valve 35 in restoring conduit 37 linked to the recovery outlet of receiver module 30. Receiver module inlet isolation valve 33 will be closed. Valve 425 will be opened allowing refrigerant flow therethrough. Refrigerant will flow from receiver module 30 to the components of AC&R 300 due to the vacuum retained therein after the removal of the nitrogen blanket.

However, it may be necessary to force the refrigerant out of receiver module 30 and into AC&R 300. In this case pressure recovery valve 111 in recovery pressure conduit 110 is opened, and throttle control valve 14 and PC valve 55 are closed. Additionally, valve 425 will be closed, forcing the refrigerant to flow through quick closing valve 415. Compressor 47 is turned on, and compressed nitrogen flows through conduits 110 and 96, and opened bypass valve 91 of liquid assurance circuit 9, and into receiver module 30. A nitrogen bubble is formed in receiver module 30, and the increasing pressure therein forces the refrigerant out of module 30 and into AC&R 300 through TRL 175. When compressed nitrogen is utilized for restoring the refrigerant, it is desired that none of the nitrogen be forced into ACR 300. However, since the pressurized refrigerant must flow through parallel conduit 420, as soon as sensor 430 senses that the refrigerant is no longer flowing through conduit 420, valve 415 will be closed by control 460. The transfer of refrigerant is completed, and flow of nitrogen into AC&R 300 is prevented.

Finally, before the connection between AC&R 300 and RPSU 1 is severed, it is desired to remove all of the remnant refrigerant vapor from conduit 170. Valves 172, 173, 59, 84 and 25 are closed, and both valve 14 and valve 121 in conduit 120 are opened. Compressed nitrogen flows to ejector 40, as in the pump down operation, creating low pressure in tank 70, and thereby causing all of the remnant refrigerant in line 170 to flow through conduit 120 and into tank 70, and eventually separator tank 20. This refrigerant may be collected by opening valve **29*b* and line cap 29*a* in line 29 as discussed above. Of course, if pressurized nitrogen has not been used to force the refrigerant from receiver module 30, remnant refrigerant vapor may also remain in receiver module 30. Thus, with valve 173 closed, valve 111 may first be opened to force the remnant refrigerant vapor from receiver module 30 into conduit 170. Then, valves 111 and 172 are closed to isolate the refrigerant in conduit 170. Valves 14 and 121** are opened, and the procedure continues as above.

This invention has been described in connection with the preferred embodiments. These embodiments are merely for example only. If will be understood by those skilled in the art that other variations and modifications can easily be made within the scope of this invention as defined by the claims.

We claim:

1. A refrigerant recovery processing and storage unit, said unit recovering refrigerant fluid from a refrigeration system, said unit comprising:

a gas motivating and pressurizing means for supplying pressurized motivating gas to an inlet of a refrigeration system and for creating a substantial vacuum at an outlet of the refrigeration system, said motivating gas flowing through the refrigeration system due to the pressure difference between the inlet and the outlet and forcing refrigerant to flow from the outlet, and a storage means for storing the refrigerant fluid.

2. The unit recited in claim 1 further comprising a separating means, said separating means receiving refrigerant fluid and motivating gas from said gas motivating and pressurizing means, said separating means for separating the motivating gas from the refrigerant fluid, the refrigerant fluid separated from the motivating gas flowing to said storage means.

3. The unit recited in claim 2, said gas motivating and pressurizing means further comprising an ejector means disposed so as to be linked to the outlet of the refrigeration system, a first conduit means for conveying a first portion of the pressurized motivating gas to the input of the refrigeration system and a second conduit means for conveying a second portion of the pressurized motivating gas to said ejector means, said ejector means for ejecting the second portion of the motivating gas from an outlet thereof and thereby creating the lower pressure at the outlet of the refrigeration system.

4. The unit recited in claim 3, said gas motivating and pressurizing means further comprising a compressor, said compressor pressurizing the motivating gas, the outlet of said compressor linked by said first conduit means to the inlet of the refrigeration system and by said second conduit means to said ejector means.

5. The unit recited in claim 4, said ejector means comprising a nozzle, a bowl and a diffuser, said bowl including an outlet opening, said diffuser disposed at said outlet opening of said bowl, said nozzle disposed in said bowl and linked by said second conduit means to said compressor outlet, said nozzle receiving the second portion of motivating gas and ejecting it therefrom into said diffuser.

6. The unit recited in claim 5, said diffuser linked to said separating means, said bowl including an inlet opening disposed so as to be linked to the outlet of the refrigeration system, wherein the ejection of the motivating gas into said diffuser creates a vacuum in said bowl, further creating the lower pressure at the outlet of the refrigeration system.

7. The unit recited in claim 4, said gas motivating and pressurizing means further comprising a throttle valve disposed in said second conduit means between the outlet of said compressor and said ejector means, said throttle valve controlling the volume of pressurized motivating gas flowing to said ejector means to thereby control the pressure level at the outlet of the refrigeration system.

8. The unit recited in claim 4, said gas motivating and pressurizing means further comprising a volume control means disposed in said first conduit means for controlling the volume of pressurized motivating gas flowing from said compressor outlet to the inlet of the refrigeration system.

9. The unit recited in claim 8, said volume control means comprising a stop valve and a pressure transducer disposed in said first conduit means, and a control system linked to said stop valve and said pressure transducer, said pressure transducer sensing the pressure in said first conduit means and transmitting a corresponding signal to said control system, said control system adjusting the degree of opening of said stop valve in response to said signal to control the volume of motivating gas flowing through said first conduit to maintain the pressure in said first conduit at a predetermined level.

10. The unit recited in claim 9, said volume control means further comprising a relief valve means disposed in said first conduit means, said relief valve means for automatically releasing excess motivating gas to the atmosphere when the pressure in said first conduit means exceed said predetermined level by a predetermined amount, said predetermined amount set by said control system.

11. The unit recited in claim 8, said gas motivating and pressurizing means further comprising a throttle valve disposed in said second conduit means between the outlet of the compressor and the ejector means, said throttle valve controlling the volume of pressurized motivating gas flowing to said ejector means to thereby control the pressure level at the outlet of the refrigeration system.

12. The unit recited in claim 1 further comprising a processing means disposed so as to be between a low pressure side of said gas motivating and pressurizing means and the outlet of the refrigeration system, said processing means receiving refrigerant fluid from the refrigeration system outlet, said processing means for converting any liquid refrigerant fluid into the gaseous state before the refrigerant fluid flows to said gas motivating and pressurizing means, the lower pressure created by said gas motivating and pressurizing means applied to the refrigeration system outlet through said processing means.

13. The unit recited in claim 12, said processing means including means for removing water and oil from the refrigerant fluid.

14. The unit recited in claim 3, said ejector means comprising a refrigerant fluid inlet, said unit further comprising a processing means linked to said inlet of said ejector means, said processing means receiving refrigerant fluid from the outlet of the refrigeration system, said processing means for converting refrigerant fluid received from the refrigeration system in the liquid state to the gaseous state to ensure that the refrigerant fluid flowing to said refrigerant fluid inlet of said ejector means is in substantially the gaseous state.

15. The unit recited in claim 14, said processing means including a tank having an outlet linked to said refrigerant fluid inlet of said ejector means, the ejection of the motivating gas by said ejector means creating a low pressure in said tank which is transferred to the outlet of the refrigeration system, refrigerant fluid flowing into said tank, the low pressure in said tank causing any refrigerant fluid in the liquid state to boil in said tank before flowing to said ejector means.

16. The unit recited in claim 15, said processing means further including a high level detecting means and a low level detecting means disposed through the walls of said tank, said high and low level detecting means for detecting the level of refrigerant fluid in the liquid state in said tank, a level control means linked to both said detecting means, and a control valve disposed so as to be between the outlet of the refrigeration system and an inlet of said tank, the extent of opening of said control valve controlled in accordance with the level of the liquid refrigerant in said tank to assure that the liquid level does not exceed the level of the high level detecting means nor fall below the level of the low level detecting means.

17. The unit recited in claim 16, said detecting means comprising ultrasonic detectors.

18. The unit recited in claim 15 further comprising an oil demister screen disposed at said outlet of said tank, and an anti-foaming plate disposed at the bottom of said tank.

19. The unit recited in claim 14, said processing means further comprising means for drying and removing lubricating oil from the refrigerant fluid.

20. The unit recited in claim 4 further comprising a returning conduit means for returning the motivating gas from said separator means to the inlet of said compressor, and a capacity control means disposed between said first conduit means and said returning conduit means, said capacity control means for maintaining a substantially constant volumetric flow rate of motivating gas through said compressor by assuring that the pressure in said second conduit means does not exceed a first predetermined level, and that the volume of motivating gas flowing into said compressor inlet through said returning conduit means does not fall below a second predetermined level.

21. The unit recited in claim 20, said capacity control means including a high pressure accumulator receiving high pressure motivating gas from said second conduit means if the pressure in said second conduit means exceeds said first predetermined level, and a low pressure accumulator linked to and receiving high pressure motivating gas from said high pressure accumulator and releasing said motivating gas to said returning conduit means should the volumetric flow of motivating gas in said returning conduit means fall below the second predetermined level.

22. The unit recited in claim 21, said capacity control means further comprising a spill valve disposed between said high pressure accumulator and said low pressure accumulator.

23. The unit recited in claim 20, said ejector means comprising a refrigerant fluid inlet, said unit further comprising a processing means linked to said refrigerant fluid inlet of said ejector means, said processing means receiving refrigerant fluid from the outlet of the refrigeration system, said processing means for converting any refrigerant fluid received from the refrigeration system in the liquid state to the gaseous state to ensure that the refrigerant fluid flowing to said ejector means inlet includes only refrigerant fluid substantially in the gaseous state.

24. The unit recited in claim 4 further comprising a pressurized gas volume control means for controlling the volume of pressurized gas flowing from said compressor outlet to said ejector means through said second conduit means, and to the inlet of the refrigeration system through said first conduit means.

25. The unit recited in claim 1 further comprising a capacity control means for controlling the flow of pressurized gas through said gas motivating and pressurizing means such that the volume of motivating gas flowing therethrough remains essentially constant.

26. The unit recited in claim 1 further comprising a halocarbon analyzer means disposed so as to between the outlet of the refrigeration system and a low pressure side of said gas motivating and pressurizing means, said analyzer means for analyzing the flow from the outlet of the refrigeration system and determining when all of said refrigerant fluid has been removed from the system.

27. The unit recited in claim 2, said separating means comprising a separator tank, mixed refrigerant gas and motivating gas flowing into said separator tank from said gas motivating and pressurizing means, and pressure and temperature maintaining means for maintaining said tank at a predetermined pressure and temperature at which said refrigerant gas condenses to a liquid.

28. The unit recited in claim 27, said separating means further comprising a refrigerant liquid outlet from which the refrigerant liquid flows, and a motivating gas outlet from which said motivating gas flows.

29. The unit recited in claim 28, said refrigerant liquid outlet linked by a liquid refrigerant conduit to said storage means, said motivating gas outlet linked by a returning conduit to said gas motivating and pressurizing means.

30. The unit recited in claim 27, said pressure and temperature maintaining means comprising a temperature sensor and a pressure transducer disposed in said tank, a central control means linked to said temperature sensor and said pressure transducer, a temperature controlling means for controlling the temperature in said tank, and a pressure controlling means for controlling the pressure in said tank, said central control means for controlling said temperature controlling means and said pressure controlling means on the basis of the temperature sensed by said temperature sensor and the pressure sensed by said pressure transducer to maintain said predetermined temperature and pressure in said tank.

31. The unit recited in claim 30, said separating means further comprising a motivating gas outlet conduit linked to said separator tank, said pressure controlling means including a separator gas outlet control valve disposed in said motivating gas outlet conduit and linked to said central control means, said temperature controlling means including a condensing coil disposed in said separator tank, a self-contained external refrigeration unit means for circulating coolant through said condensing coil, and a thermo-expansion valve disposed in a conduit between said self-contained refrigeration unit and said condensing coil, said thermo-expansion valve linked to said central control means, said central control means controlling the degree of opening of said separator gas outlet control valve to control the flow of motivating gas from said separator tank to control the pressure in said tank, and the degree of opening of said thermo-expansion valve to control the flow of coolant from said external refrigeration unit means to said condensing coil through said thermo-expansion valve to control the temperature in said tank.

32. The unit recited in claim 30, said separator tank including a minimum liquid level maintenance means for maintaining a minimum level of refrigerant liquid in said tank.

33. The unit recited in claim 29, said separator tank including a minimum liquid level maintenance level means for maintaining a minimum level of refrigerant liquid in said tank.

34. The unit recited in claim 33, said minimum liquid level maintenance means comprising a tank level control valve disposed in said liquid refrigerant conduit and a float disposed in said tank, said float and said tank level control valve interacting to control the degree of opening of said tank level control valve to control the flow of liquid refrigerant fluid from said tank to maintain a minimum liquid refrigerant level in said tank.

35. The unit recited in claim 4, said separating means comprising a separator tank, mixed refrigerant gas and motivating gas flowing into said separator tank from said ejector means, said unit further comprising pressure and temperature maintaining means for maintaining said separator tank at a predetermined pressure and temperature at which said refrigerant gas condenses to a liquid.

36. The unit recited in claim 35, said separating means further comprising a refrigerant liquid outlet from which the refrigerant liquid flows, and a motivating gas outlet from which said motivating gas flows.

37. The unit recited in claim 36, said refrigerant liquid outlet linked by a liquid refrigerant conduit to said storage means, said motivating gas outlet linked by a returning conduit to the inlet of said compressor.

38. The unit recited in claim 35, said pressure and temperature maintaining means comprising a temperature sensor and a pressure transducer disposed in said separator tank, a central control means linked to said temperature sensor and said pressure transducer, a temperature controlling means for controlling the temperature in said tank, and a pressure controlling means for controlling the pressure in said tank, said central control means controlling said temperature controlling means and said pressure controlling means on the basis of the temperature sensed by said temperature sensor and the pressure sensed by said pressure transducer to maintain said predetermined temperature and pressure in said tank.

39. The unit recited in claim 38, said separating means further comprising a motivating gas outlet conduit linked to said separating tank, said pressure controlling means including a separator gas outlet control valve disposed in said motivation gas outlet conduit and linked to said central control means, said temperature controlling means including a condensing coil disposed in said separator tank, a self-contained external refrigeration unit means for circulating coolant through said condensing coil, and a thermo-expansion valve disposed in a conduit between said self-contained refrigeration unit means and said condensing coil, said thermo-expansion valve linked to said central control means, said central control means controlling the degree of opening of said separator gas outlet control valve to control the flow of motivating gas from said separator tank to control the pressure in said tank, and the degree of opening of said thermo-expansion valve to control the flow of coolant from said external refrigertion unit means to said condensing coil through said thermo-expansion valve to control the temperature in said tank.

40. The unit recited in claim 38, said separator tank including a minimum liquid level maintenance means for maintaining a minimum level of refrigerant liquid in said tank.

41. The unit recited in claim 37, said separator tank including a minimum liquid level maintenance means for maintaining a minimum level of refrigerant liquid in said tank.

42. The unit recited in claim 41, said minimum liquid level maintenance means comprising a tank level control valve disposed in said liquid refrigerant conduit and a float disposed in said tank, said float and said tank level control valve interacting to control the degree of opening of said tank level control valve to control the flow of liquid refrigerant fluid from said tank to maintain a minimum liquid level in said tank.

43. The unit recited in claim 1, said storage means comprising a detachable receiver module.

44. The unit recited in claim 43, the inlet of said receiver module having a quick disconnect fitting.

45. The unit recited in claim 4, said storage means comprising a detachable receiver module.

46. The unit recited in claim 45, the inlet of said receiver module having a quick disconnect fitting.

47. The unit recited in claim 27, said storage means comprising a detachable receiver module.

48. The unit recited in claim 47, the inlet of said receiver module having a quick disconnect fitting.

49. The unit recited in claim 2 further comprising a liquid assurance circuit means disposed between said separator means and said storage means, said liquid assurance circuit means assuring that only refrigerant in the liquid state flows from said separator means to said storage means.

50. The unit recited in claim 49, said liquid assurance circuit means comprising a quick closing valve, gas detecting means disposed in series with said quick closing valve for detecting the presence of refrigerant gas, and a liquid assurance control system, said liquid assurance control system receiving a signal from said gas detecting means when the presence of gaseous refrigerant is detected by said gas detecting means, said liquid assurance control system closing said quick closing valve in response to the signal from said gas detecting means.

51. The unit recited in claim 50, said liquid assurance circuit further comprising a bypass valve disposed in parallel with both said gas detecting means and said quick closing valve.

52. The unit recited in claim 50, said gas detecting means comprising an ultrasonic detector.

53. The unit recited in claim 4, further comprising a liquid assurance circuit means disposed between said separator means and said storage means, said liquid assurance circuit means assuring that only refrigerant in the liquid state flows from said separator means to said storage means.

54. The unit recited in claim 53, said liquid assurance circuit means comprising a quick closing valve, gas detecting means disposed in series with said quick closing valve for detecting the presence of refrigerant gas, and a liquid assurance control system, said liquid assurance control system receiving a signal from said gas detecting means when the presence of gaseous refrigerant is detected by said detecting means, said liquid assurance control system closing said quick closing valve in response to the signal from said gas detecting means.

55. The unit recited in claim 54, said liquid assurance circuit further comprising a bypass valve disposed in parallel with both said gas detecting means and said quick closing valve.

56. The unit recited in claim 54, said gas detecting means comprising an ultrasonic detector.

57. The unit recited in claim 12 further comprising a liquid assurance circuit means disposed between said gas motivating and pressurizing means and said storage means, said liquid assurance circuit means assuring that only refrigerant in the liquid state flows to said storage means.

58. The unit recited in claim 57, said liquid assurance circuit means comprising a quick closing valve, a gas detecting means disposed in series with said quick closing valve for detecting the presence of refrigerant gas, and a liquid assurance control system, said liquid assurance control system receiving a signal from said gas detecting means when the presence of gaseous refrigerant is detected by said gas detecting means, said liquid assurance control system closing said quick closing valve in response to the signal from said gas detecting means.

59. The unit recited in claim 58, said liquid assurance circuit further comprising a bypass valve disposed in parallel with both said gas detecting means and said quick closing valve.

60. The unit recited in claim 58, said gas detecting means comprising an ultrasonic detector.

61. The unit recited in claim 25 further comprising a liquid assurance circuit means disposed between said gas motivating and pressurizing means and said storage means, said liquid assurance circuit means assuring that only refrigerant in the liquid state flows to said storage means.

62. The unit recited in claim 61, said liquid assurance circuit means comprising a quick closing valve, gas detecting means disposed in series with said quick closing valve for detecting the presence of refrigerant gas, and a liquid assurance control system, said liquid assurance control system receiving a signal from said gas detecting means when the presence of gaseous refrigerant is detected by said gas detecting means, said liquid assurance control system closing said quick closing valve in response to the signal from said gas detecting means.

63. The unit recited in claim 62, said liquid assurance circuit further comprising a bypass valve disposed in parallel with both said gas detecting means and said quick closing valve.

64. The unit recited in claim 62, said gas detecting means comprising an ultrasonic detector.

65. The unit recited in claim 28, further comprising a liquid assurance circuit means disposed between said separator means and said storage means, said liquid assurance circuit means assuring that only refrigerant in the liquid state flows from said separator means to said storage means.

66. The unit recited in claim 65, said liquid assurance circuit means comprising a quick closing valve, gas detecting means disposed in series with said quick closing valve for detecting the presence of refrigerant gas, and a liquid assurance control system, said liquid assurance control system receiving a signal from said gas detecting means when the presence of gaseous refrigerant is detected by said gas detecting means, said liquid assurance control system closing said quick closing valve in response to the signal from said gas detecting means.

67. The unit recited in claim 66, said liquid assurance circuit further comprising a bypass valve disposed in parallel with both said gas detecting means and said quick closing valve.

68. The unit recited in claim 66, said gas detecting means comprising an ultrasonic detector.

69. The unit recited in claim 3, said gas motivating and pressurizing means further comprising a portable booster ejector manifold including a booster ejector means disposed between said ejector means and the refrigeration system.

70. The unit recited in claim 4, said gas motivating and pressurizing means further comprising a portable booster ejector manifold including a booster ejector means disposed between said ejector means and the refrigeration system.

71. A refrigerant recovery processing and storage unit, said unit recovering refrigerant fluid from a refrigeration system, said unit comprising:

gas motivating and pressurizing means for supplying pressurized motivating gas to an inlet of the refrigeration system and for creating a lower pressure at the outlet of the refrigeration system than at the inlet, said gas motivating and pressurizing means further comprising an ejector means having a refrigerant fluid inlet disposed so as to be linked to the outlet of the refrigeration system and a pressurized motivating gas inlet, a first conduit means for conveying a first portion of pressurized motivating gas to the inlet of the refrigeration system and a second conduit means for conveying a second portion of pressurized motivating gas to said motivating gas inlet of said ejector means, said ejector means for ejecting the second portion of the motivating gas from an outlet thereof thereby creating the lower pressure at the outlet of the refrigeration system, said motivating gas flowing through the refrigeration system due to the pressure difference between the inlet and the outlet and forcing refrigerant fluid to flow from the outlet, and storage means for storing the refrigerant fluid.

72. The unit recited in claim 71, said gas motivating and pressurizing means further comprising a compressor, said compressor pressurizing the motivating gas, the outlet of said compressor linked by said first conduit means to the inlet of the refrigeration system and by said second conduit means to said ejector means.

73. The unit recited in claim 72, said ejector means comprising a nozzle, a bowl and a diffuser, said bowl including an outlet opening, said diffuser disposed at said outlet opening of said bowl, said nozzle disposed in said bowl and linked by said second conduit means to said compressor outlet, said nozzle receiving the second portion of motivating gas and ejecting it therefrom into said diffuser.

74. The unit recited in claim 71, said storage means comprising a detachable receiver module.

75. The unit recited in claim 71 further comprising a capacity control means for controlling the flow of pressurized gas through said gas motivating and pressurizing means such that the volume of gas flowing therethrough remains essentially constant.

76. The unit recited in claim 71 further comprising a processing means disposed so as to be between said refrigerant fluid inlet of said ejector means and the outlet of the refrigeration system, said processing means receiving refrigerant fluid from the refrigeration system outlet, said processing means for converting liquid refrigerant fluid into the gaseous state before the refrigerant fluid flows to said ejector means, the lower pressure created by the ejection of motivating gas applied to the refrigeration system outlet through said processing means.

77. A method for removing refrigerant fluid from a refrigeration system, said method comprising the steps of:

pressurizing and supplying motivating gas to an inlet of a refrigeration system;

creating a substantial vacuum at an oulet of the refrigeration system, said pressurized motivating gas thereby flowing through the refrigeration system and forcing refrigerant fluid to flow from the outlet;

and storing the refrigerant fluid forced from the refrigeration system.

78. The method recited in claim 77 comprising the further step of returning the stored refrigerant fluid to the refrigeration system.

79. The method recited in claim 77 comprising the further step of separating the refrigerant fluid from the motivating gas before storing the refrigerant fluid.

80. The method recited in claim 79, said step of separating the refrigerant fluid from the motivating gas comprising the further step of causing said refrigerant fluid and said motivating gas to flow to a separator tank, and maintaining the tank at a suitable temperature and pressure so as to cause refrigerant fluid in the gaseous state to condense to the liquid state and flow from the bottom of the tank to a storage tank, said motivating gas flowing from the top of the tank.

81. The method recited in claim 80 comprising the further step of assuring that only liquid refrigerant flows from the separator tank to the storage tank such that the flow of motivating gas from the separator tank to the storage tank is prevented.

82. The method recited in claim 77, substantially 100% of the refrigerant fluid removed from the refrigeration system and stored.

83. A method for removing refrigerant fluid from a refrigerating system, the method comprising the steps of:

pressurizing a motivating gas and causing a first portion of said pressurized motivating gas to flow to an inlet of the refrigeration system;

causing a second portion of the pressurized motivating gas to be ejected from a nozzle at high velocity, said nozzle disposed in a bowl linked to the outlet of the refrigeration system, wherein the ejection of the second portion creates a lower pressure at the outlet than at the inlet of the refrigeration system such that said first portion of motivating gas flows through the refrigeration system and drives the refrigerant fluid from the outlet and into said bowl.

84. The method recited in claim 83, said refrigerant fluid flowing from the outlet entrained in the ejected second portion of motivating gas and creating a mixture of motivating gas and refrigerant fluid, the method comprising the further step of separating the mixed refrigerant fluid and motivating gas and storing the refrigerant fluid.

85. The method recited in claim 84 comprising the further step of assuring that the refrigerant fluid flowing to the bowl is in the gaseous state.

86. A refrigerant recovery and storage unit comprising:

gas motivating and pressurizing means for supplying pressurized motivating gas to an inlet of a refrigeration system and for creating a lower pressure at an outlet of the refrigeration system than at the inlet, said motivating gas flowing through the refrigeration system due to the pressure difference between the inlet and the outlet and forcing refrigerant fluid to flow from the outlet, wherein, said motivating gas comprises a non-refrigerant fluid.

87. The unit recited in claim 86, further comprising a storage means for storing the refrigerant fluid flowing from the outlet.

88. A refrigerant recovery and storage unit comprising:

means for supplying pressurized motivating gas to an inlet of a refrigeration system and means for causing the pressure at the outlet of the refrigeration system to be lower than the pressure at the inlet of the refrigeration system, said motivating gas flowing through the refrigeration system due to the pressure difference between the inlet and the outlet and forcing refrigerant fluid to flow from the outlet.

89. The unit recited in claim 88, further comprising a storage means for storing the refrigerant fluid flowing from the outlet.

90. The unit recited in claim 88, said means for supplying comprising a compressor and said means for causing comprising an ejector.

91. A method for removing refrigerant fluid from a refrigeration system, said method comprising the steps of:

creating a gas cap drive with a non-refrigerant gas at an inlet of the refrigeration unit, the gas cap drive forcing the refrigerant fluid to flow from an outlet of the refrigeration unit;

and storing the refrigerant fluid flowing from the outlet of the refrigeration unit.

92. The method recited in claim 91, comprising the further step of separating the gas utilized in the gas cap drive from the refrigerant fluid.

93. A method for removing refrigerant fluid from a refrigeration system comprising a condenser, an evaporator and a compressor, said method comprising the steps of:

isolating one or more components of the refrigeration system from the other components of the refrigeration system;

pressurizing and supplying motivating gas to an inlet of the refrigeration system;

creating a substantial vacuum at an outlet of the refrigeration system, said pressurized motivating gas thereby flowing through the non-isolated components of the refrigeration system and forcing the refrigerant fluid from the outlet; and storing the refrigerant fluid forced from the refrigeration system.

94. The method recited in claim 93, comprising the further steps of:

de-isolating any components which were isolated, after the refrigerant fluid has been driven from the non-isolated components;

pressurizing and supplying motivating gas to an inlet of the refrigeration system a second time;

creating a lower pressure at an outlet of the refrigeration system than at the inlet a second time, said pressurized motivating gas thereby flowing through said non-isolated components of the refrigerating system and forcing the refrigerant fluid from the outlet; and storing the refrigerant fluid forced from the refrigeration system.

95. The method recited in claim 94, comprising the further step of restoring the stored refrigerant to the refrigeration unit.

96. The method recited in claim 93, the isolated components comprising at least the compressor.

97. The method recited in claim 93, comprising the further step of restoring the stored refrigerant to the refrigeration unit.

98. The method recited in claim 97, the step of restoring comprising utilizing pressurized motivating gas to force the stored refrigerant fluid to flow to the refrigeration unit.

99. A refrigerant recovery processing unit comprising:

gas motivating and pressurizing means for supplying pressurized motivating gas to an inlet of a refrigeration system and for creating a lower pressure at an outlet of the refrigeration system than at the inlet, said motivating gas flowing through the refrigeration system due to the pressure difference between the inlet and the outlet and forcing refrigerant fluid to flow from the outlet;

separating means for separating the refrigerant fluid from the motivating gas.

100. The unit recited in claim 99, further comprising storage means for storing the separated refrigerant.

101. A refrigerant recovery processing unit comprising:

a compressor;

an ejector, said ejector comprising a bowl and a nozzle;

means for linking the outlet of the compressor to an inlet of a refrigeration system and to said nozzle; and means for linking an outlet of the refrigeration system to said bowl.

102. The unit recited in claim 101, further comprising a storage means for storing refrigerant fluid.

103. A refrigerant recovery processing unit comprising:

gas motivating and pressurizing means for supplying pressurized motivating gas to an inlet of a refrigeration system and for creating a lower pressure at an outlet of the refrigeration system than at the inlet, the motivating gas flowing through the refrigeration system due to the pressure difference between the inlet and the outlet and forcing refrigerant fluid to flow from the outlet, said gas motivating and pressurizing means comprising an ejector;

first means for linking said gas pressurizing and motivating means to an inlet of the refrigeration system;

second means for linking said ejector to an outlet of the refrigeration system, motivating gas and refrigerant fluid flowing through said second means to said ejector;

processing means disposed in said second means, said processing means for converting any liquid refrigerant fluid to the gaseous state before the refrigerant fluid flows to said ejector.

104. The unit recited in claim 103, further comprising storage means for storing refrigerant fluid forced from the outlet.

105. The unit recited in claim 103, said processing means also filtering and dehydrating the refrigerant fluid.

106. A refrigerant recovery processing unit comprising:

gas motivating and pressurizing means for supplying pressurized motivating gas to an inlet of a refrigeration system and for creating a substantial vacuum at an outlet of the refrigeration system, the motivating gas flowing through the refrigeration system due to the pressure difference between the inlet and the outlet and forcing refrigerant fluid to flow from the outlet; and capacity control means for controlling the flow of pressurized motivating gas through said gas motivating and pressurizing means.

107. A refrigerant recovery processing unit comprising:

a compressor, said compressor pressurizing a motivating gas;

an ejector, said ejector comprising a bowl and a nozzle;

first means for linking the outlet of the compressor to said nozzle, pressurized motivating gas flowing from said compressor to said nozzle through said first means;

second means for linking the outlet of said nozzle to the inlet of said compressor, motivating gas flowing from said nozzle to said compressor through said second means; and capacity control means for maintaining a substantially constant volumetric flow of motivating gas through said compressor.

108. The unit recited in claim 107, said capacity control means disposed between said first and second means.

109. The unit recited in claim 108, said capacity control means including high pressure means for receiving high pressure motivating gas from said first means if the pressure in said first means exceeds a first predetermined level, and low pressure means for receiving high pressure motivating gas from said high pressure means and for releasing said motivating gas to said second means whenever the volumetric flow of motivating gas in said second means falls below a second predetermined level.

110. The unit recited in claim 107, further comprising storage means for storing refrigerant fluid.

* * * * *